United States Patent [19]

Won

[11] Patent Number: 4,658,841

[45] Date of Patent: Apr. 21, 1987

[54] ASSEMBLED WIG OR WIG KIT

[76] Inventor: Duk S. Won, West Haverstraw, N.Y.

[21] Appl. No.: 758,438

[22] Filed: Jul. 24, 1985

[51] Int. Cl.[4] ..... A41G 3/00
[52] U.S. Cl. ..... 132/53
[58] Field of Search ..... 132/53, 54

[56] References Cited

U.S. PATENT DOCUMENTS

| | | | |
|---|---|---|---|
| 3,385,305 | 5/1968 | Buzzelli | 132/53 |
| 3,458,943 | 8/1969 | Trowbridge | 132/53 |
| 3,495,603 | 2/1970 | Young, Jr. | 132/53 |
| 3,809,100 | 5/1974 | Megna | 132/53 |
| 3,910,292 | 10/1975 | Izzo | 132/53 |
| 4,016,888 | 4/1977 | Smiley | 132/53 |

FOREIGN PATENT DOCUMENTS

| | | | |
|---|---|---|---|
| 2834769 | 2/1979 | Fed. Rep. of Germany | 132/53 |
| 342365 | 9/1904 | France | 132/53 |
| 1388300 | 3/1975 | United Kingdom | 132/53 |

*Primary Examiner*—Gene Mancene
*Assistant Examiner*—Cary E. Stone
*Attorney, Agent, or Firm*—Birch, Stewart, Kolasch & Birch

[57] ABSTRACT

The disclosure describes an assembled wig or wig kit comprising a front wig portion having a plurality of hook-type fasteners and side links, and a back wig portion having a plurality of links and side hook-type fasteners secured to the fasteners and links wherein the front and back wig portions have different hair styles or colors.

8 Claims, 5 Drawing Figures

ASSEMBLED WIG OR WIG KIT

FIELD OF THE INVENTION

The present invention relates to an assembled wig and more particularly to an improved and inexpensive wig which is assembled with a different stylized front wig portion and back wig portion for changing the style of the wig very simply and quickly.

BACKGROUND OF THE INVENTION

Many types of wigs which the fiber or hair is attached to the cap thereof, for example, a capless, kinky hair or jerry curl wig, have been developed and are used extensively in the wig industry.

One disadvantage of these wigs is that numerous sets of the wig become necessary when wearers decide to change their hair styles. Besides, conventional wigs are fitted to the scalp of the wearers so that their heads become very warm thereby causing discomfort. Even though U.S. Pat. No. 3,809,100 to Megna discloses a wig which comprises a form and a cap covered the form which may be a single section or may optionally be composed of a face, crown and nape sections instead of a single section for a versatile style of wig construction, it is expected to be difficult and complicated for operation and manufacture because the wig of this patent has a form and a plurality of sections.

SUMMARY OF THE INVENTION

The present invention relates to an assembled wig comprising front and back wig portions having a different hair style or color. In particular, the present invention relates to wig which has a front wig portion and a back wig portion, each portion having a different hair style and/or color respectively. The front and back wig portions are assembled together by connecting members such as Velcro fasteners and loops, or the like. In this way, a narrow opening may be provided between the front and back wig portions in order to allow air to pass to the wearer's head to eliminate the discomfort of conventional wigs. The assembled wig may include a front wig portion formed of a front cap and front hair fibers secured to said front cap portion, a back wig portion formed of a back cap and back hair fibers secured to said back cap portion, and connecting means for connecting said front cap portion to said back cap portion at a plurality of independent locations whereby an air space is left between said front and back portions and between said plurality of independent locations.

The assembled wig of the present invention is utilized the stylized wig which is suited wearer's face because the wear can combine each front and back wigs, for example a straight long hair wig, a front curl-middle straight-back curly long wig or front all over curl-middle length-back straight hair wig etc. Furthermore, hair styles having multiple colors are popular "new wave" hair styles. Thus, the wig may be sold in a kit which includes a front wig portion formed of a front cap and front hair fibers secured to said front cap, a back wig portion formed of a back cap and first back hair fibers secured to said back cap, wherein said back cap can be connected with said front cap, and a second back wig portion formed of a second back cap and second back hair fibers wherein said second back hair fibers have a style or color different from said first hair fibers.

In one aspect of the invention, the wig of the present invention comprises a front wig portion having a loop and hook-type (Velcro) fastener and a back wig portion having a link extended from a support band thereof. The front wig portion can be worn alone by pinning the back portion hair through the loop and hook-type fastener thereof, or said back wig portion can be worn alone by pinning the front portion hair through the link thereof.

Also, the wig of the present invention is composed of two wig portions whereby the time for manufacturing the entire wig of the present invention may be shorter than the time for manufacturing a conventional single wig. Because the part wig of the present invention is a small size so that it can be mass-produced.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
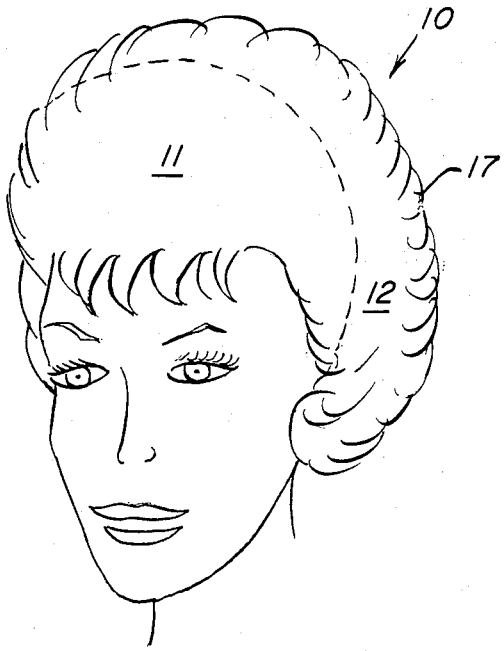
FIG. 1 is a perspective view showing an assembled wig illustrating a preferred embodiment of the present invention attached to a woman's head.
Figure 2:
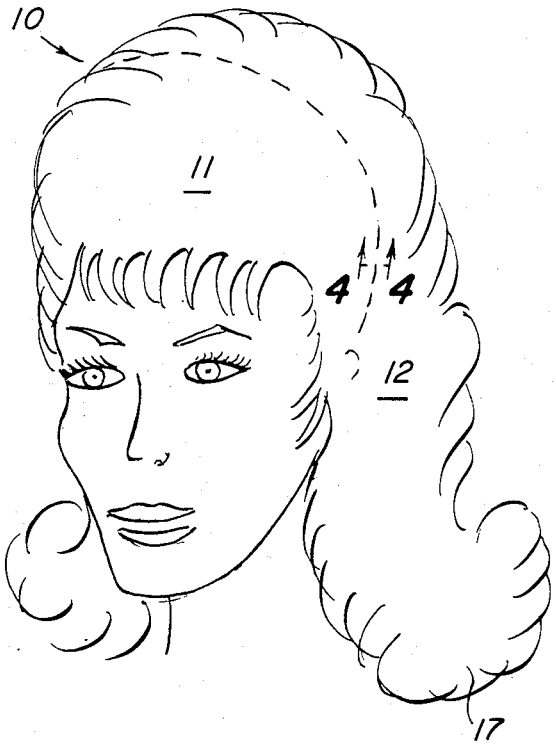
FIG. 2 is a perspective view showing an assembled wig wherein the back of the wig is different from the back wig of FIG. 1.

Referring to FIGS. 1 and 2, two assembled wigs 10 illustrating a preferred embodiment of the present invention are shown attached to a woman's head. The assembled wig 10 of the present invention comprises a front wig portion 11 connected to a back wig portion 12.

Hair or fiber 17 is attached to a front cap 15 which may be a front part and a little of the back part of a conventional cap of a wig. Fiber or hair 17 is also attached to a back cap 16 which may be a half of a conventional cap of a wig. It is to be understood that in this description and claims the word "hair" is not to be restricted to natural hair but also to include natural or synthetic fibers 17 that are attached to the cap to simulate the natural hair of the wearer of the wig 10.

The wig is formed from a front head band 25 and a back head band 26 which are adjustably and removably connected together by a side link 18 through which a Velcro (loop and hook-type) fastener 22 is inserted. A side link 18 and Velcro fastener 22 are provided on each side of the wig.

The hairs are substantially attached to a plurality of strings 27 of the caps 15 and 16 which extend across the wig from the left to the right.

Figure 3:
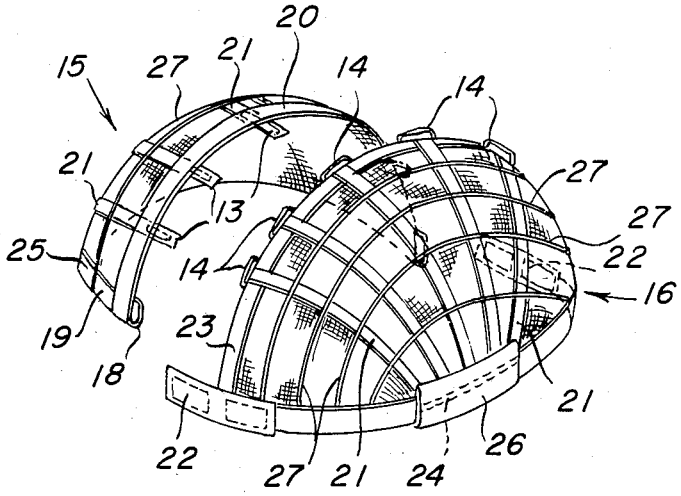
FIG. 3 is an enlarged perspective view of the cap portion of the wig of the present invention.

As shown in FIG. 3, the front cap 15 has a side link disposed at a side portion 19, a transverse support band 20 disposed at a connecting area thereof and a Velcro fastener 13 disposed at the connecting end of each of a plurality of longitudinal support bands 21. Velcro fasteners 13 are looped through corresponding links 14 on the back cap 16.

The back cap 16 comprises a side hook-type Velcro fastener 22 located at the side portion 19 which is secured to the side link 18 of the front cap 15, a transverse support band 23 disposed at the connecting area thereof, an adjustable member such as an elastic cord 24 located within the back head band 26, and a pularity of the links 14 disposed at the connecting end of each longitudinal support band 21.

Figure 5:
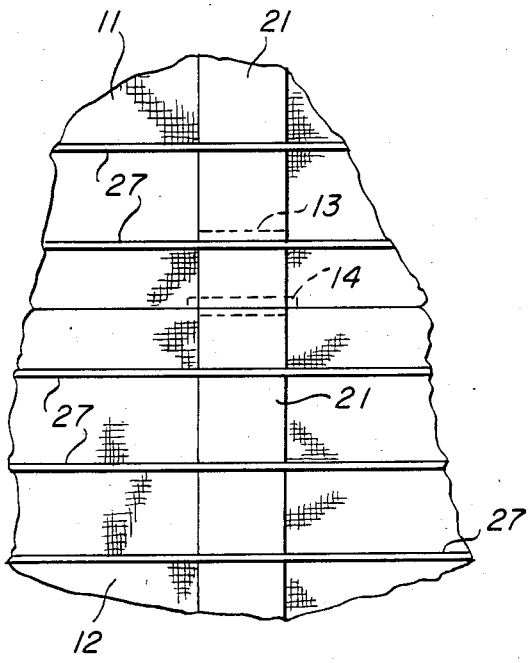
FIG. 5 is a plan view of a connecting portion of the assembled wig of the present invention with the hair removed.

In operation, the wearer who selects the desired front wig 15 and the back wig 16 connects the plurality of hook fasteners 13 of the front wig 15 and the side hook fasteners 22 of the back wig 16 into the plurality of links 14 of the back wig 16 and side links 18 of the front wig 15 as shown in FIG. 5.

Figure 4:
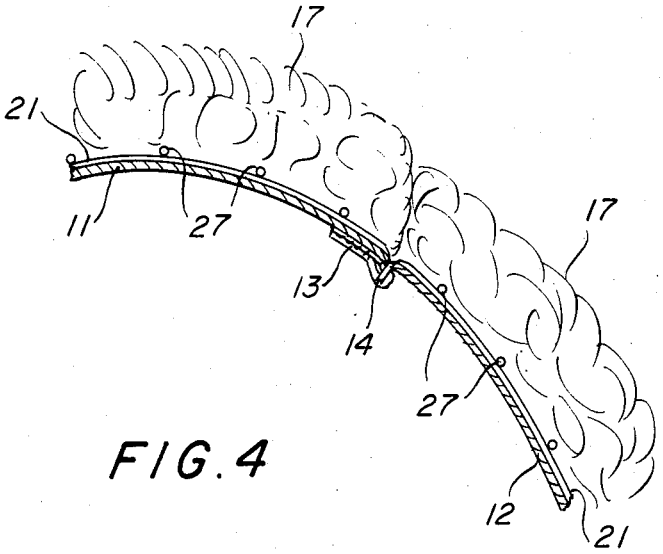
FIG. 4 is a cross-sectional view of a connecting portion of the assembled wig of FIG. 1 of the present invention taken along lines 4—4 of FIG. 2.

Then the plurality of hook fasteners 13 and fasteners 22 the plurality of links 14 and 18 are hooked and fastened to secure the front wig 15 to the back wig 16 as shown in FIG. 4. In this way, a narrow opening appears between the front wig 15 and the back wig 16 to enable air to pass through the assembled wig which eliminates the discomfort and the sweat of the wearer's head. Sometimes, in accordance with wearer's favor, he can utilize a front wig 15 or a back wig 16 with the hair of a front or back portion of his own head by pinning the wig through the plurality fasteners or links.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An assembled wig, comprising:

a front wig portion formed of a front cap having a plurality of front hook-type fasteners and side links and hair secured to the front cap, said plurality of front hook-type fasteners being disposed at the ends of longitudinal support bands of the front cap of the front wig portion; and a back wig portion formed of a back cap having a plurality of back links secured to said front hook-type fasteners, and side hook-type fasteners secured to said side links of said front cap and hair secured to said back cap cap.

2. The assembled wig of claim 1, wherein the front and back wig portions each occupy about a half portion of a whole wig.

3. The assembled wig of claim 1, wherein a link is disposed at each side portion of the cap of the front wig portion.

4. The assembled wig of claim 1, wherein a side fastener is disposed at each side portion of the cap of the back wig portion.

5. The assembled wig of claim 1, wherein the plurality of links are disposed at the ends of longitudinal support bands of the back cap of the back wig portion.

6. The assembled wig of claim 1, wherein said links are made of a metallic material which is covered by a fabric.

7. An assembled wig, comprising:

a front wig portion formed of a front cap and front hair fibers secured to said back cap portion, at least one of said front or back cap portions having longitudinal support bands;

connecting means for connecting said front cap portion to said back cap portion at a plurality of independent locations, said connecting means being connected with the support bands whereby an air space is left between said front and back portions and between said plurality of independent locations.

8. A wig kit, comprising:

a front wig portion formed of a front cap and front hair fibers secured to said front cap;

a back wig portion formed of a back cap and first back hair fibers secured to said back cap, wherein said back cap can be connected with said front cap, at least one of said front or back cap portions having longitudinal support bands;

connecting means for connecting said front cap portion to said back cap portion at a plurality of independent locations, said connecting means being connected with said support bands whereby an air space is left between said front and back portions and between said plurality of independent locations; and a second back wig portion formed of a second back cap and second back hair fibers wherein said second back hair fibers have a style or color different from said first hair fibers.

* * * * *